United States Patent [19]

Smith, Jr. et al.

[11] 4,144,102

[45] Mar. 13, 1979

[54] PRODUCTION OF LOW EXPANSION SUPERALLOY PRODUCTS

[75] Inventors: Darrell F. Smith, Jr.; Edward F. Clatworthy; Donald E. Wenschhof, Jr., all of Huntington, W. Va.

[73] Assignee: The International Nickel Company, Inc., New York, N.Y.

[21] Appl. No.: 824,810

[22] Filed: Aug. 15, 1977

Related U.S. Application Data

[62] Division of Ser. No. 703,528, Jul. 8, 1976, Pat. No. 4,066,447.

[51] Int. Cl.[2] ..... C21D 7/14; C22F 1/10; C22C 38/06; C22C 38/48

[52] U.S. Cl. ..... 148/2; 148/11.5 N; 148/12 R; 148/12.3; 148/31; 148/32.5

[58] Field of Search ..... 148/2, 11.5 N, 12 R, 148/12.3, 32.5, 31, 142, 162; 75/122, 134, 171, 124, 128 G, 128 T, 128 B, 128 F

[56] References Cited

U.S. PATENT DOCUMENTS

| | | | |
|---|---|---|---|
| 3,157,495 | 11/1964 | Eiselstein | 75/134 F |
| 3,514,284 | 5/1970 | Eiselstein | 75/123 J |
| 3,705,827 | 12/1972 | Muzyka et al. | 148/142 |
| 3,929,470 | 12/1975 | Gray | 75/128 T |
| 3,930,904 | 1/1976 | Eiselstein | 75/122 |
| 3,940,295 | 2/1976 | Lupton et al. | 75/122 |
| 3,971,677 | 7/1976 | Mason et al. | 75/122 |
| 4,006,012 | 2/1977 | Kindlimann | 75/122 |

OTHER PUBLICATIONS

Eiselstein, "An-Age Hardenable, Low-Expansion Alloy for Cryogenic Service," Advances in Cryogenic Engineering, (1967), pp. 508-519.

*Primary Examiner*—Arthur J. Steiner
*Attorney, Agent, or Firm*—Raymond J. Kenny; Ewan C. MacQueen

[57] ABSTRACT

Nickel-iron and nickel-iron-cobalt alloys contain chromium and gamma-prime hardening elements in proportions balanced according to special compositional relationships providing desired thermal expansion, inflection temperature, strength and ductility characteristics, particularly including notch strength needed in machinery and structures subjected in use to varying temperatures and thermal gradients where operating temperatures become elevated above 500° F.

5 Claims, No Drawings

PRODUCTION OF LOW EXPANSION SUPERALLOY PRODUCTS

This is a division, of application Ser. No. 703,528, filed July 8, 1976, now U.S. Pat. No. 4,066,447.

The present invention relates to nickel-iron base alloys and more particularly to nickel-iron alloys characterized by specially low coefficients of expansion.

Heretofore there have been needs for heat-resistant structural articles for use in structural situations having special restrictions on thermal expansion, for instance, articles for supporting or for forming seals between gas turbine engine components that become heated to different temperatures during engine operation. Among other considerations, differences in engine operating conditions, e.g., takeoff power and cruise power, can have different thermal gradients across or along the engine assembly. Also, differences in thermal expansion characteristics of different metals in an engine contribute to thermal expansion difficulties. To overcome thermal expansion difficulties at special places in turbine engines, and other heat powered engines and heated structures, which can be very complex, there are needs for controlling thermal expansion to relatively low levels such as about half the thermal expansion of about 8 to $9 \times 10^{-6}$ per degree Fahrenheit that characterizes many of the high strength heat-resistant alloys used for gas turbine components. In view of such needs, alloy products and articles characterized by small coefficients of thermal expansion in the range of about $3 \times 10^{-6}$/° F. to $6 \times 10^{-6}$° F. are specially desired. Moreover, inasmuch as most components of turbines are heated hundreds of degrees above room temperature, the small coefficient should be maintained closely constant up to temperatures elevated substantially above room temperature, e.g., about 500° F. or 600° F., and desirably higher.

Heretofore there have been discoveries of nickel-iron compositions characterized by very low expansion coefficients, some practically zero, e.g., an alloy of 36% nickel and balance iron, and there have been teachings of special alloy compositional control for proportioning nickel and iron, with or without cobalt or other elements, in order to obtain desired expansion coefficients and special inflection temperatures. Moreover, the art has learned to strengthen special nickel-iron controlled expansion alloys by adding precipitation hardening elements such as aluminum, titanium and columbium and has taught obtaining particularly desired thermoelastic coefficients with control of alloy composition that also provides low expansion characteristics. For instance, precipitation-hardened nickel-iron-cobalt alloys having thermal expansion coefficients in the range of $3.8 \times 10^{-6}$ to $5.6 \times 10^{-6}$ in./in./° F. are referred to in "New Ni-Fe-Co Alloys Provide Constant Modulus + High Temperature Strength" by H. L. Eiselstein and J. K. Bell, Materials in Design Engineering, July 1965. Where the desire for use moves from laboratory instrument use to industrial and transportation use, such as for gas turbine engines, needs of additional qualities for service in industrially produced forms become particularly important. Among other things, needs for strength and toughness where structures have notches, and needs for strength in structures that are heated to high elevated temperatures, such as 1200° F., even if above the inflection temperature, and needs to endure thermal fatigue and shock, and in some special instances, needs to tolerate extraordinary heating if required for treating other members of an assembly, for instance, when a portion of an associated structure must be heated to brazing or welding temperature, are serious considerations. Furthermore, it must be understood that assembled structures for engines, vehicles, etc. are often subjected to stresses in a variety of directions and isotropy of alloy product characteristics is highly desirable, or sometimes necessary.

There has now been discovered an alloy having a specially controlled composition that enables production of heat-treated wrought products having desired combinations of thermal expansion and strength characteristics.

It is an object of the invention to provide an alloy, and products thereof, for obtaining low expansion and high strength properties.

Other objects and advantages of the invention will be apparent from the following description.

In the present invention, certain difficulties of obtaining satisfactory notch-strength, particularly 1200° F. notch-rupture strength, in high-strength low-expansion nickel-iron alloy products strengthened with gamma-prime precipitates are overcome, or at least ameliorated, with additions of small, specially controlled, amounts of chromium, such as about 2% or 5% chromium. The invention is specially beneficial for providing enhanced notch-rupture strength in recrystallized wrought nickel-iron alloy products containing 30% or more each of nickel and iron and characterized by thermal expansion coefficients not greater than about $6 \times 10^{-6}$/° F. up to inflection temperatures of at least 550° F. and by yield strengths of 110,000 pounds per square inch or higher along with good elevated temperature strength. In a number of instances, chromium in amounts of 1.8% to 4.8% has been effective for the invention. It is also contemplated that larger amounts such as about 6% or 8% chromium may be included. The invention includes an alloy composition that is specially controlled with compositional relationships wherein certain elements of the composition are mutually correlated to insure satisfactory characteristics of thermal expansion coefficient, inflection temperature, yield strength, notch-strength and ductility with an alloy containing, by weight, about 30% to 55% or 57% nickel, 1.7% to 8.3% chromium, advantageously 1.7% to 5.5% chromium, 1% to 2% titanium, 1.5% to 5% columbium, up to 31% cobalt, up to 1.5% aluminum, up to about 0.06% or 0.10% carbon and possibly up to 0.20% carbon, up to about 2% manganese, up to about 1% silicon, up to 0.03% boron, advantageously 0.002% to 0.012% boron, and balance iron in an amount of at least 34% and with the composition further controlled to satisfy the following relationships:

(A) $\%Ni+0.88(\%Co)-1.70(\%Al)-2.01(\%Ti)+0.26(\%Mn+\%Cr)$ equal up to (and not greater than)51.8

(B) $\%Ni+1.13(\%Co)-2.69(\%Al)-1.47(\%Ti)-1.93(\%Mn)-2.51(\%Cr)+1.87(\sqrt{\%Cr})$ at least 40.8

(C) $\%Al+1.3(\%Ti)+1.44(\%Cb)-0.12(\%Cb)^2-0.37(\%Cr)+0.03(\%Cr)^2$ at least 3.81

(D) $\%Al+1.3(\%Ti)+0.25(\%Cb)-0.125(\%Cr)$ equal up to 3.18

The foregoing relationships A, B, C and D are particularly directed at controlling the expansion coefficient, inflection temperature, yield strength and notch strength characteristics, respectively, of recrystallized age-hardened wrought products. Herein, in reference to products of the invention, age-hardening, aging, aged and like terms refer to the kind of strengthening known as gamma-prime precipitation hardening, involving precipitation of $Ni_3(Al, Cb, Ti, Ta)$ and possibly including the body-centered tetragonal gamma double-prime. Relationship D is also beneficial for obtaining adequate ductility and resistance to strain age cracking during welding. With the composition controlled in accordance with the foregoing ranges and relationships, the invention is particularly successful in providing high strength, controlled expansion, wrought products characterized in the recrystallized and age-hardened condition by thermal expansion coefficients in the range of 3.0 to $5.8 \times 10^{-6}$° F., inflection temperatures of at least 550° F., room temperature yield strength of at least 110,000 psi and 1200° F. notch rupture strength sufficient for life of at least 48 hours at stress of 70,000 psi(70 ksi). It is also to be noted that the recrystallized condition provides isotropic benefits of an equiaxed grain structure.

Tantalum may be present as an associate of columbium obtained from commercial sources, and may be about one-tenth or less of the amount of columbium in the alloy or can be deliberately added. It is contemplated that tantalum may be substituted for part, one-half, or all of the columbium provided the tantalum is twice the weight percentage of columbium deleted. Accordingly, it is understood the alloy can contain metal from the group columbium, tantalum and mixtures thereof in proportions whereby the weight percent of columbium plus ½ the weight percent of tantalum is 1.5% to 5% of the alloy. And for relationships A, B, C and D, any incorporation of tantalum is to be at one-half the weight percent present. Thus relationships (C) and (D) can be stated as:

(C') $\%Al+1.3(\%Ti)+1.44(\%Cb+\frac{1}{2}Ta)-0.12(\%Cb+\frac{1}{2}Ta)^2-0.37(\%Cr)+0.03(\%Cr)^2$ at least 3.81

(D') $\%Al+1.3(\%Ti)+0.25(\%Cb+\frac{1}{2}Ta)-0.125(\%Cr)$ up to 3.18

It is also to be understood the alloy can contain deoxidants and/or malleabilizers, e.g., 0.01% calcium, 0.01% magnesium, 0.10% zirconium and other elements in amounts that do not destroy the desired characteristics. Tolerable impurities include up to 1% copper, up to 1% molybdenum, up to 1% tungsten, up to 0.015% phosphorus and up to 0.015% sulfur.

Silicon content is desirably maintained not greater than about 0.5% to ensure good forgeability and weldability.

The alloy can be prepared by melting practices known for production of high quality nickel-iron alloys. Induction melting, by air melt practices and by vacuum melt practices, has been found satisfactory. Other melt practices, e.g., electroflux melting or vacuum-arc melting or remelting, can be utilized if desired. The alloy has good malleability for hot working and for cold working. Moreover, with the alloy composition controlled in accordance with the invention, warm-working followed by recrystallization annealing provides satisfactory results, including good notch-rupture strength characteristics. Herein, warm working refers to the special kind of cold working that is conducted at elevated, nearly hot, temperatures that are below and yet within a few hundred degrees of the alloy recrystallization temperature, e.g., 30° F. to 300° F. below the recrystallization temperature of the alloy being worked. Recrystallized products of the alloy are characterized by equiaxed grain structures that are advantageous for obtaining isotropic strength properties and other properties. Among other benefits, the satisfactoriness of the alloy for warm working methods is beneficial to efficiency and economy in commercial production inasmuch as forging, rolling or other working of the alloy can be continued while the alloy cools down from the hot working range and through and below the recrystallization temperature, thus avoiding lost time and expense of interrupting working in order to reheat.

Hot working of ingots of the alloy can commence at around 2100° F. and can continue down to the warm working range and, if desired, working of the hot-worked alloy can continue as the alloy cools into the warm working range. Reheating for recrystallization annealing of the warm worked alloy is generally done in the range of about 1700° F. to 1900° F. for about one hour to one-quarter hour, depending, of course, on the amount of work energy retained while working below the recrystallization temperature. Annealing one hour at 1700° F., or ¼-hour at 1900° F., or proportionately therebetween, is desirable for producing fine-grain structures. Fine-grain structures are advantageous for ensuring good notch-rupture strength and high room-temperature strength; yet, in some embodiments the alloy has good notch-rupture strength in both the coarse and the fine grain conditions.

In reference to products of the invention, grain structures referred to as recrystallized fine are characterized by an average grain size of up to about ASTM No. 5, frequently ASTM No. 5 to No. 8, whereas grain structures referred to as recrystallized coarse have an average grain size of about ASTM No. 4.5 or larger, frequently ASTM No. 2 to No. 4.

Recrystallization annealing at temperatures of at least 1700° F. also serves toward placing the alloy in a homogeneous solid-solution condition with most, if not all, the gamma-prime forming elements in solution, as preparation for an aging treatment. (The anneal is not a carbide-solution anneal.) Water quenching after annealing is desirable for retaining the solution condition until the next treatment step, although in some instances a slower cooling, e.g., air cooling, may be satisfactory.

The alloy is strengthened by aging at temperatures of about 1150° F. for about 8 or more hours. Desirably, the hot-worked alloy, with or without warm or cold working, is placed in a solid-solution condition prior to aging, albeit good results may in some instances be obtainable without a full solution treatment. An especially satisfactory aging treatment comprises, in continuous sequence, holding at 1325° F. for 8 hours, furnace cooling therefrom at a rate of 100° F. per hour to 1150° F., holding at 1150° F. for 8 hours and then cooling in air, or in the furnace, to room temperature.

Generally, in both the fine-grain and the coarse-grain conditions, the age-hardened products have at least 110 ksi yield strength and about 8% or moe tensile elongation at room temperature and attain at least 2% smooth-bar stress-rupture elongation at 1200° F.

The products are ferromagnetic at room temperature and at higher temperatures up to about the inflection temperature. It should be understood that as a practical matter, the inflection temperature may differ a few degrees, or 10° F. or 20° F., from the Curie temperature.

Advantageously, for production of products characterized by thermal expansion coefficients not exceeding $5 \times 10^{-6}$/° F. and inflection temperatures of at least 620° F., the alloy composition is controlled to contain 30% to 55% nickel, 1.7% to 5.5% chromium and up to 27.5% cobalt and is proportioned to provide that Rel. A (relationship A) does not exceed 48.8 and Rel. B is at least 43.5.

For ensuring particularly good strength, including room temperature yield strength of at least 130 ksi and 1200° F. rupture strength sufficient to sustain loads of 85 ksi for 48 hours in both smooth-bar and notch-bar configurations when the product is in the fine-grain annealed condition, the above mentioned 30–55Ni/1-.7–5.5Cr composition is further controlled to contain at least 2.2% columbium and Rel. C is at least 4.92.

Hereafter, it is to be understood that rupture strengths of embodiments of the invention refer to strengths in both smooth and notch configurations, with notch $K_t$ at least 3.5, and elongations refer to elongation after fracture in a smooth-bar configuration.

Another embodiment wherein aluminum is no greater than 0.8% and titanium no greater than 1.6%, and wherein %Cb × %Cr is no less than 7 (Rel. E), and relationship C is at least 4.36 provides at least 120 ksi yield strength and 10% elongation at room temperature and at least 85 ksi rupture strength for 48 hr. life at 1200° F. in the coarse grain annealed condition.

In another embodiment wherein aluminum is restricted to not exceed 0.4%, %Cb+½%Ta restricted to not exceed 4% and relationship C is at least 4.36, advantageously good stress-rupture ductility of at least 5% elongation at 1200° F. is obtained in the fine-grain condition while room temperature yield strength is at least 120 ksi.

In a particularly closely restricted embodiment, aluminum is up to 0.4% and (Cb+½Ta) is up to 4% and Rel. C is at least 4.36 and Cb × Cr is at least 7.0 and, with this, advantageously good ductility characteristics of 5% rupture elongation and 10% room temperature elongation and 120 ksi yield strength, or better, are obtained in the coarse-grain condition.

Especially good 1200° F. rupture strength (for at least 48 hr. life) of at least 95 ksi along with advantageous room temperature characteristics of at least 130 ksi yield strength is achieved with coarse-grain embodiments containing up to 0.8% aluminum and up to 1.6% titanium and 2.9% to 5.0% columbium and proportioned to have Rel. C at least 4.92 and %Cb × %Cr at least 7.0. Rupture elongation is 2% or better; when 5% is desired, aluminum should be restricted to not exceed 0.4% and (Cb+½Ta) to not exceed 4%.

Stress-rupture elongation of at least 5% along with 85 ksi rupture strength at 1200° F., is obtained with fine-grain products having 2.2% to 4.0% columbium (or Cb+½Ta), up to 0.4% aluminum and Rel. C at least 4.92.

For purposes of giving those skilled in the art a further understanding of the practice and advantages of the invention, the following examples are given.

EXAMPLE I

A melt for an alloy, referred to herein as alloy 1, containing about 38.5% nickel, 15.5% cobalt, 4.5% chromium, 1.5% titanium, 0.6% aluminum, 2% manganese, 0.005% boron and balance iron (about 35% iron) was prepared by air-induction melting elemental metals, and chromium and columbium ferro-alloys, of commercial-grade high purity. Aluminum, titanium and small amounts of ferroboron were added shortly before the melt was ready for tapping. Deoxidation was by a 0.06% calcium addition. The alloy was cast and solidified in an ingot mold in an air atmosphere. Results of chemical analysis of alloy 1 and calculations of Relationships A, B, C, D and E for alloy 1 are set forth hereinafter in Table IA, respectively. The ingot was heated for homogenization at 2150° F. for 12 to 16 hours and hammer-forged at about 2050° F. to an 11/16-inch square, which was about 50% over the planned final billet size. Then the hot-worked billet was cooled on the hammer to 1600° F. and final forged to 9/16-inch square bars and air-cooled. Forging finished at about 1500° F. or slightly lower and resulted in the warm-worked condition. Specimens for short time tensile tests, stress-rupture tests and thermal expansion tests were machined from bars of alloy 1 in the warm-worked (as-forged) condition and were treated by annealing and aging after machining. Annealing was in an air atmosphere furnace for one hour at the annealing temperature and water quenching to room temperature. Some of the warm-worked bars were annealed at 1625° F., others at 1700° F. The anneal at 1700° F. fully recrystallized the microstructure; the 1125° F. anneal resulted in a partially recrystallized structure with a mixture of longitudinal grains and equiaxed grains. The 1700° F. anneal resulted in recrystallized fine-grained structures with average grain size in the range of 0.0012-inch to 0.0018-inch diameter. For aging, the alloy was reheated in air to 1325° F., held 8 hours at 1325° F., then furnace cooled to 1150° F. at a cooling rate of 100° F. per hour, then held 8 hours at 1150° F. and thereafter air cooled to room temperature. The aging treatment resulted in strengthening the alloy by precipitating gamma prime in a gamma phase matrix. Results of short-time tensile testing the thus prepared heat-treated wrought products of alloy 1 by standard procedures for testing mechanical properties including 0.2% offset yield strength (YS) and ultimate tensile strength (UTS) in kips per square inch (ksi), tensile elongation (El) along 1.0 inch gage length and reduction of area (RA) across 0.252 inch diameter gage section at room temperature and 1200° F. and of dilatometer measurements to determine the mean coefficient of thermal expansion (COE) and the inflection temperature (IT) are set forth in the following Table II. Expansion measurements were made on alloys annealed at 1550° F. or higher, since expansion test experience has indicated that COE and IT values are little effected by annealing temperatures in the range of about 1550° F. to 1900° F. which result in the partially recrystallized or fine grained structures. These values are only slightly effected (i.e., 3% increase in COE) by the use of coarse grain anneals. Results of stress-rupture tests at 1200° F., performed on forged-and-heat treated smooth-bar specimens (0.200-inch diameter, 1.000-inch gage length) and on larger diameter notch-bar specimens having a 0.200-inch diameter notch, which for this example was machined to provide a stress concentration ($K_t$) of 4.1 are set forth, along with heat treatment and grain size information, in Table III. In order to accelerate termination of the tests, stress-rupture loads were increased after specimens had demonstrated sufficient strength, including notched section strength, for withstanding tensile loads of 70 ksi for at least 48 hours. In view of results in Table III showing extended life beyond 48 hours in presence of a more than ordinarily severe notch-stress concentration with $K_t = 4.1$, it is evident that after fine-grain recrystallizing at 1700° F. alloy 1 had notch-strength more than amply sufficient for at least 48 hour life with 70 ksi stress at 1200° F.

EXAMPLE II

An alloy having the chemical analyses and compositional relationships shown for alloy 2 in Tables I and IA was prepared by vacuum induction melting raw materials of the kind used in example I, vacuum-cast and solidified to ingot form and then homogenized and hammer forged to a 50% oversize billet by the practices used for example I. Melt deoxidation was again by a 0.06% calcium addition. The billet was reheated at 1600° F. then forged to final size of about 9/16-inch square. Results of heat treating and testing specimens by practices generally paralleling those of example I and using combination smooth/notch bar specimens having a more usual notch $K_t$ of 3.6 and varied anneals are set forth in Tables II and III.

Results of testing other examples of products prepared by vacuum melting, forging and heat treating according to procedures of examples I and II and as indicated in the tables are also set forth in the following tables.

Grain structures referred to in the following tables as recrystallized fine were generally equiaxed with average grain sizes up to 0.0025-inch diameter, mostly 0.0009-inch to 0.0022-inch diameter; those referred to as recrystallized coarse were equiaxed with average grain sizes greater than 0.0030-inch diameter, mostly 0.0035-inch to 0.005-inch diameter. The incompletely recrystallized structures in the products annealed at 1550° F. or 1625° F. have a substantial portion, such as one-half or more of the structure, with longitudinally oriented warm-worked grains having aspect ratios of about 2:1 to 4:1 and transverse grain sizes that appeared to be fine when viewed on cross-section.

Metallurgical examination, by optical microscopy and X-ray diffraction, of specimens obtained from the foregoing examples showed the annealed-plus-aged structures consisted of a gamma matix having a precipitation-strengthening gamma-prime phase and discontinuous, globular, carbides in the grain boundaries. The gamma-prime was of an ultra fine size that was not resolved by optical magnification up to 1000X, the presence being confirmed by diffraction. No phases other than carbides were evident in the grain boundaries.

Coefficients of expansion (COE) set forth in Table II are mean coefficients of linear thermal expansion averaged from dilatometer measurements between room temperature and inflection temperature. Inflection temperatures (IT) set forth in the table were determined by the tangent intersection method.

Expansion of products of alloys 4 and 7 was further tested at temperatures above the inflection temperature and showed mean COE values, from room temperature to 1200° F., of $6.0 \times 10^{-6}$/° F. and $6.5 \times 10^{-6}$/° F. respectively. The mean COE of alloy 7 reached $6 \times 10^{-6}$ at about 1050° F.

For ensuring good inflection temperature characteristics, it is desirable to have at least 7% cobalt in the alloy.

TABLE I

| Alloy No. | Chemical Analyses (weight percent) | | | | | | | | | | |
|---|---|---|---|---|---|---|---|---|---|---|---|
| | Ni | Co | Cr | Cb* | Ti | Al | C | Si | Mn | B | Fe |
| 1 | 38.55 | 15.45 | 4.45 | 3.17 | 1.45 | 0.61 | 0.01 | 0.13 | 1.97 | 0.003 | Bal. |
| 2 | 34.69 | 17.80 | 1.92 | 2.99 | 1.45 | 0.28 | 0.02 | 0.07 | 0.01 | 0.008 | Bal. |
| 3 | 34.83 | 17.47 | 1.97 | 4.30 | 1.44 | 0.31 | 0.02 | 0.06 | 0.02 | 0.007 | Bal. |
| 4 | 37.94 | 15.07 | 1.83 | 3.10 | 1.41 | 0.78 | 0.02 | 0.08 | 0.10 | 0.007 | Bal. |
| 5 | 33.82 | 19.72 | 2.01 | 1.87 | 1.45 | 0.85 | 0.02 | 0.07 | 0.02 | 0.006 | Bal. |
| 6 | 38.28 | 15.30 | 3.04 | 3.19 | 1.40 | 0.94 | 0.02 | 0.09 | 0.02 | 0.008 | Bal. |
| 7 | 38.08 | 15.00 | 3.80 | 3.10 | 1.44 | 0.75 | 0.02 | 0.08 | 0.04 | 0.006 | Bal. |
| 8 | 38.32 | 15.37 | 4.85 | 3.10 | 1.42 | 0.94 | 0.02 | 0.09 | 0.02 | 0.009 | Bal. |

*including up to about 0.5% tantalum.

Bal. - Balance (except for minor amounts of impurities, e.g., 0.005% or 0.01% sulfur and 0.02% copper.

TABLE IA

| Alloy No. | Rel. A | Rel. B | Rel. C | Rel. D | Rel. E |
|---|---|---|---|---|---|
| 1 | 49.84 | 41.16 | 4.84 | 2.73 | 14.1 |
| 2 | 47.42 | 49.6 | 4.81 | 2.67 | 5.7 |
| 3 | 47.26 | 49.20 | 5.57 | 3.01 | 8.4 |
| 4 | 47.51 | 48.49 | 5.36 | 3.16 | 5.6 |
| 5 | 47.30 | 49.18 | 4.39 | 2.95 | 3.7 |
| 6 | 48.09 | 46.52 | 5.31 | 3.17 | 9.7 |
| 7 | 48.08 | 44.87 | 4.99 | 2.92 | 11.7 |
| 8 | 48.63 | 42.92 | 5.05 | 2.95 | 15.0 |

Rel. = Relationship

TABLE II

| Alloy No. | Anneal ° F/Hour | Gr. St. | Room Temperature YS, ksi | UTS, ksi | El., % | R.A., % | COE $\times 10^{-6}$/° F. | IT ° F. |
|---|---|---|---|---|---|---|---|---|
| 1 | 1625/1 | IR | 163.5 | 212.5 | 19 | 42 | 4.91 | 570 |
| | 1900/.25 | RF | 132.5 | 196.0 | 21 | 41 | | |
| | 1900/1 | RC | 132 | 192.5 | 20 | 40.5 | | |
| 2 | 1700/1 | RF | 157 | 188 | 17.5 | 40 | 4.35 | 780 |
| | 1900/.25 | RF | 142.0 | 184.0 | 20 | 44 | | |
| | 1900/1 | RC | 141 | 183.5 | 17 | 64 | | |
| 3 | 1700/1 | RF | 169 | 200 | 16 | 39.5 | 4.20 | 760 |
| | 1900/.25 | RF | 156.5 | 195.5 | 17 | 39 | | |
| 4 | 1550/1 | IR | 177 | 207 | 15 | 40 | 4.35 | 785 |
| | 1900/.25 | RF | 148.5 | 195.0 | 17 | 45.5 | | |
| | 1900/1 | RC | 151.5 | 200 | 16 | 42 | | |
| 5 | 1700/1 | IR | 151 | 187 | 18 | 49 | 4.30 | 820 |
| | 1900/.25 | RF | 136.0 | 183.0 | 18 | 46 | | |
| | 1900/1 | RC | 144 | 179 | 18 | 40 | | |
| 6 | 1900/.25 | RF | 139.5 | 193.0 | 22 | 44 | 4.66 | 723 |
| | 1900/1 | RC | 136.5 | 189.5 | 22 | 45.5 | | |
| 7 | 1550/1 | IR | 176.5 | 205.5 | 15 | 26 | 4.53 | 700 |
| | 1900/.25 | RF | 137.5 | 195.0 | 26 | 44.5 | | |
| | 1900/1 | RC | 140.5 | 198.5 | 21 | 37 | | |
| 8 | 1900/.25 | RF | 131.0 | 189.0 | 24 | 46.5 | 4.70 | 595 |
| | 1900/1 | RC | 134.5 | 189 | 23 | 50 | | |
| | | | 1200° F. | | | | | |
| 1 | 1625/1 | IR | 141 | 146 | 21 | 45 | | |
| 2 | 1900/1 | RC | 102 | 126 | 22 | 44 | | |
| 4 | 1550/1 | IR | 148 | 150 | 23 | 53 | | |
| | 1900/1 | RC | 120 | 148 | 10 | 19 | | |
| 7 | 1550/1 | IR | 141.5 | 147 | 23.5 | 61.5 | | |
| | 1900/1 | RC | 119.5 | 153 | 16 | 18.5 | | |

Heat Treatment - Annealed as indicated, Water Quench, plus age of 1325° F/8 hrs., Furnace Cool 100° F. per hr. to 1150° F/8 hrs., Air Cool Gr. St. = Grain Structure -

IR- Incompletely recrystallized

RF- Recrystallized equiaxed fine grain,

RC- Recrystallized equiaxed coarse grain,

COE = Mean COE up to inflection temperature

IT = Inflection Temperature

TABLE III

| Alloy No. | Anneal, ° F/Hour | Gr. St. | 1200° F. Stress-Rupture Stress, ksi | Life, Hours | Elong., % | | R.A., % | Fracture Stress, ksi |
|---|---|---|---|---|---|---|---|---|
| 1 | 1625/1.0 | IR | 70.0+ | 151.3 | 7 | | 11 | 115SB |
| | 1625/1.0 | IR | 70.0+ | 279.5 | | FAN | | 130*3 |
| | 1700/1.0 | RF | 70.0+ | 149.5 | 3 | | 4 | 110SB |
| | 1700/1.0 | RF | 70.0+ | 142.3 | | FAN | | 100*3 |
| 2 | 1625/1.0 | IR | 85.0 | 116.7 | 16 | | 25 | — |
| | 1900/.25 | RF | 85.0 | 205.7 | 12 | | 17 | — |
| | 1900/1.0 | RC | 95.0 | 4.1 | | FAN | | |
| 3 | 1625/1.0 | IR | 85.0 | 8.8 | 10.5 | | 42 | — |
| | 1900/.25 | RF | 85.0*2 | 232.6 | 4 | | 11 | 100 |
| | 1900/1.0 | RC | 95.0 | 90.4 | | FAN | | |
| 4 | 1550/1.0 | IR | 70.0+ | 106.0 | 25 | | 29 | 100 |
| | 1900/.25 | RF | 85.0 | 678.3 | 6.5 | | 4.5 | |
| | 1900/1.0 | RC | 95.0 | 1.6 | | FAN | | |
| 5 | 1625/1.0 | IR | 85.0 | 133.8 | 11.5 | | 17 | |
| | 1900/.25 | RF | 85.0 | 67.5 | 4.5 | | 7.5 | |
| | 1900/1.0 | RC | 95.0 | 6.4 | 3.0 | | 8.5 | |
| 6 | 1900/.25 | RF | 85.0+ | 71.2 | | FAN | | 100 |
| | 1900/1.0 | RC | 95.0 | 0.2 | | FAN | | |
| 7 | 1550/1.0 | IR | 70.0+ | 144.4 | 19.5 | | 33.5 | 110 |
| | 1900/.25 | RF | 85.0*1 | 1101.6 | 6 | | 2.5 | 120 |
| | 1900/1.0 | RC | 95.0*2 | 219.0 | | FAN | | 100 |
| 8 | 1900/.25 | RF | 85.0*4 | 157.0 | 4 | | 3.5 | 100 |
| | 1900/1.0 | RC | 95.0 | 2.2 | | FAN | | |

Heat treatment — Annealed as indicated, Water Quench, plus 1325° F/8 hrs., Furnace Cool 100° F. per hr. to 1150° F/8 hrs., Air Cool
Test Specimen — Combination 0.178" dia. smooth and notch tensile bar with 0.715-inch smooth gage length and notch $K_t$ of 3.6 except where other noted
+ — after 48 hours, stress increased 5 ksi every 8–12 hours
*1 — after 1000 hours, stress increased 5 ksi every 8–12 hours
*2 — after 215 hours, stress increased 5 ksi every 12 hours
*3 — $K_t$ = 4.1 (0.200-inch dia. notch in 0.283-inch dia. bar)
*4 — after 48 hours, stress increased 5 ksi every 48 hours
FAN — Fracture at Notch, elongation not measured
SB — Smooth Bar specimen (0.20-in. dia., 1.0-in. G.L.)

In further illustration of the invention, compositional ranges and melting aims for preparing alloys of the invention characterized by small expansion coefficients of about $4.25 \times 10^{-6}$ in./in./° F. are set forth in conjunction with exemplary physical and mechanical characteristics in Table IV. If desired, the proportions of nickel, cobalt and iron can be adjusted, within the ranges and according to the relationships of the invention, in order to vary the expansion characteristics, for instance, by increasing Rel.A to increase the expansion coefficient.

TABLE IV

| Alloy | % Ni Range (Aim) | % Co Range (Aim) | % Cr Range (Aim) | % Al Range (Aim) | % Cb Range (Aim) | % Ti Range (Aim) | I.T. (F °) | Y.S. R.T. (ksi) | 1200° F. Rupture Notch Strth. RF | RC | Elong.* % |
|---|---|---|---|---|---|---|---|---|---|---|---|
| A | 36–40(38) | 13–17(15) | 1.7–2.2(2) | 0.3–0.85(0.7) | 2.4–3.5(3) | 1.0–1.8(1.4) | 760 | 148 | S | U | 5 |
| B | 36–40(38) | 12–16(14) | 3.7–4.2(4) | 0.3–0.85(0.7) | 2.4–3.5(3) | 1.0–1.8(1.4) | 640 | 137 | S | S | 5 |
| C | 36–40(38) | 12–16(14) | 1.7–2.2(2) | 0.1–0.5(0.3) | 2.4–3.5(3) | 1.0–1.8(1.4) | 760 | 142 | S | U | 12 |
| D | 36–40(38) | 11–15(13) | 3.7–4.2(4) | 0.1–0.5(0.3) | 2.4–3.5(3) | 1.0–1.8(1.4) | 640 | 130 | S | S | 10 |
| E | 36–40(38) | 12–16(14) | 1.7–2.2(2) | 0.1–0.5(0.3) | 3.4–4.5(4) | 1.0–1.8(1.4) | 760 | 155 | S | S | 5 |
| F | 36–40(38) | 11–15(13) | 2.7–3.2(3) | 0.1–1.5(0.3) | 3.4–4.5(4) | 1.0–1.8(1.4) | 700 | 150 | S | S | 5 |
| G | 36–40(38) | 12–16(14) | 2.7–3.2(3) | 0.1–0.5(0.3) | 2.9–3.5(3) | 1.0–1.8(1.4) | 700 | 135 | S | S | 10 |

Alloys Having Average Coefficient of Thermal Expansion of $4.25 \times 10^{-6}$/in./in./° F.
Elong.* = Smooth Bar elongation of fine-grain condition
Balance of above is iron and up to: 0.05%C, 1% Mn, 0.35%Si, 0.5%Cu, 0.015%S, 0.015%P and 0.012%B (aim 0.006%B)
S = Satisfactory Notch Strength (at least 48 hour life at 1200° F./70 ksi with $K_t$ of 3.6
U = Unsatisfactory Notch Strength An especially recommendable composition for obtaining a particularly good combination of expansion, strength and ductility characteristics in the recrystallized-plus-aged condition, along with good forgeability and other fabricability for production of articles and structures, including brazed or welded structures, contains 36% to 40% nickel, 12% to 16% cobalt, 1.8% to 3.2% chromium, 3% to 4% columbium, 1.2% to 1.6% titanium, 0.1% to 0.4% aluminum, up to 0.06% carbon, 0.002% to 0.012% boron and balance essentially iron in an amount of at least 36%. For production associated with this composition, ductility characteristics can be favored by aiming at about 3%, or 2.75% to 3.25%, columbium, or, strength characteristics can be favored with an aim of about 4%, or 3.75% to 4.25% columbium.

The present invention is applicable in the production of wrought products and articles for machines and structures that are heated and cooled to a variety of temperatures from room temperature to elevated temperatures such as 600° F. or 1200° F. and is particularly applicable to gas turbine components such as seals, brackets, flanges, shafts, bolts, and casings.

The good fabricability of the alloy is beneficial for providing versatility in using the alloy to obtain required strength and other characteristics in a variety of production situations, for instance, where it is desired to confine forging to the hot working range when the alloy is relatively soft and forgeable with relatively low pressure and wear on the dies, or, for different production conditions, where it is more economical to extend working down into the warm working range.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

The embodiments of the invention in which an exclusive property or privilege is claimed are defined as follows:

1. A process for preparing a precipitation-hardened wrought product comprising establishing a melt of an alloy consisting essentially of 30% to 57% nickel, 1.7% to 8.3% chromium, 1% to 2% titanium, metal from the group columbium, tantalum and mixtures thereof in proportions providing the total percentage of columbium plus one-half the percentage of tantalum is 1.5% to 5%, up to 31% cobalt, up to 1.5% aluminum, up to 0.2% carbon, up to about 2% manganese, up to about 1% silicon, up to 0.03% boron and balance essentially iron in an amount of at least 34% of the alloy and having the composition proportioned in accordance with the following four relationships A, B, C' and D' whereby:

(A) $\%Ni+0.88(\%Co)-1.70(\%Al)-2.01(\%Ti)+0.26(\%Mn+Cr)$ equal up to 51.8

(B) $\%Ni+1.13(\%Co)-2.69(\%Al)-1.47(\%Ti)-1.93(\%Mn)-2.51(\%Cr)+1.87(\%Cr)$ at least 40.8

(C') $\%Al+1.3(\%Ti)+1.44(\%Cb+\frac{1}{2}Ta)-0.12(\%Cb+\frac{1}{2}Ta)^2-0.37(\%Cr)+0.03(\%Cr)^2$ at least 3.81

(D') $\%Al+1.3(\%Ti)+0.25(\%Cb+\frac{1}{2}Ta)-0)125(\%Cr)$ up to 3.18 solidifying the alloy in a mold, separating the alloy and the mold, hot working the solidified alloy at temperature of about 2100° F. and below, and thereafter age-hardening the alloy with a heat treatment of at least 8 hours in the temperature range of 1350° F. to 1150° F.

2. A process as set forth in claim 1 comprising, following said hot-working and preceding said age-hardening, warm working the alloy at a temperature about 30° F. to about 300° F. below the recrystallization temperature and then reheating the alloy sufficiently above the recrystallization temperature of recrystallize the warm-worked alloy.

3. A product of the process as set forth in claim 1 wherein the amount of chromium is about 2% to about 5%.

4. A product of the process as set forth in claim 1 characterized by an average grain size of ASTM No. 4.5 or coarser.

5. A product of the process as set forth in claim 1 characterized by an average grain size of ASTM No. 5 or finer.

* * * * *